US006128828A

United States Patent [19]

Wang

[11] Patent Number: 6,128,828

[45] Date of Patent: Oct. 10, 2000

[54] DRYING MACHINE

[76] Inventor: Chao-Chun Wang, No. 5, Lane 411, Chung Shan Road, Shan Hua Chen, Tainan Hsien, Taiwan

[21] Appl. No.: 09/361,517

[22] Filed: Jul. 27, 1999

[51] Int. Cl.[7] ..... F26B 11/02

[52] U.S. Cl. ..... 34/134; 34/135; 34/141; 34/180; 34/182; 34/185; 34/187

[58] Field of Search ..... 34/134, 135, 140, 34/141, 179, 180, 181, 182, 185, 187; 432/107, 112, 113, 114; 366/25, 15, 40; 110/229, 233, 346

[56] References Cited

U.S. PATENT DOCUMENTS

| | | | |
|---|---|---|---|
| 1,571,076 | 1/1926 | Warren | 34/134 X |
| 3,486,740 | 12/1969 | Christian | 34/134 X |
| 3,716,925 | 2/1973 | Hartung | 34/235 X |
| 3,946,996 | 3/1976 | Gergely | 34/182 X |
| 3,999,304 | 12/1976 | Doty | 34/86 X |
| 4,122,612 | 10/1978 | Mrofchak | 34/86 |
| 4,137,647 | 2/1979 | Clark, Jr. | 34/86 X |
| 4,146,975 | 4/1979 | Duhem | 34/134 |
| 5,347,729 | 9/1994 | Meyer | 34/180 |
| 5,397,177 | 3/1995 | Swisher, Jr. | 366/25 |
| 5,555,823 | 9/1996 | Davenport | 110/346 |
| 5,570,516 | 11/1996 | Huang | 34/180 X |
| 5,628,126 | 5/1997 | North | 34/235 X |
| 5,806,205 | 9/1998 | Varvat | 34/185 X |

*Primary Examiner*—Stephen Gravini
*Attorney, Agent, or Firm*—Rosenberg, Klein & Lee

[57] ABSTRACT

A drying machine includes a hot air blower, a housing divided horizontally into plural long chambers having an open upper side, a closed bottom and two longitudinal sides bored with through holes, a screw conveyor respectively positioned in each long chamber, and a motor to rotate all the screw conveyors, and a sending-out screw conveyor positioned on the bottom of the housing. Each screw conveyor has an inner screw and an outer screw twisting in opposite direction for conveying, squeezing, mixing and stirring material at the same time dried by hot air coming from the blower. Material falls down from a funnel on the upper side of the housing and gradually falling down through the through holes and an outlet in an end of the bottom of the highest long chamber and then into a second highest long chamber and so on to the lowest portion of the housing to be conveyed by the sending-out screw conveyor to an exit through which dried material falls down through for collected.

4 Claims, 5 Drawing Sheets

DRYING MACHINE

BACKGROUND OF THE INVENTION

This invention relates to a drying machine, particularly to one performing automatically all drying processes, wherein material to be dried squeezed, mixed, stirred and dried at the same time, having effect of fast drying and balanced condition.

A kind of conventional drying machine shown in FIG. 4, includes an outer housing 10, an inner housing 20 and a frame 30 positioned firmly in the inner housing 20, and a plurality of horizontal trays 301 removably inserted in the frame 30, and a hot air blower 40 to produce and send hot air through many through holes 201 formed in the inner housing 20.

Another kind of conventional drying machine shown in FIG. 5, includes an outer housing 50, a tool cart 70 with a plurality of trays 701 movably inserted in the tool cart 70 for receiving material to be dried thereon. The inner housing 60 has many through holes 601 in its sidewalls for hot air produced by the hot air blower 80 to pass through into the inner housing 60.

The two conventional drying machines described just above are deemed to have the following disadvantages.

1. Material to be dried are to be placed on the trays 301, 701, and then the trays 301, 701 are to be inserted in the frame 30 or the tool cart 70 for being dried. After material is dried on the trays 301, 701, the trays 301, 701 are to be pulled out to collect the dried material, with all the work to be done manually, needing much labor and time.
2. Material is dried on the trays 301, 701, without stirred or moved, resulting in a long time in drying and unbalanced dried condition of material.

SUMMARY

The object of the invention is to offer a drying machine including a hot air blower to produce hot air, a housing divided horizontally into a plurality of long chambers having their upper side open, a screw conveyor respectively deposited in each long chamber and rotated by a motor. Each screw conveyor has an outer screw and an inner screw twisting in opposite direction, and the outer screw of the screw conveyors of two neighboring long chambers twist in opposite direction. Further, a funnel is provided on an upper side of the housing, having its bottom mouth facing down to the highest long chamber. Each long chamber has an outlet in an end of the bottom, and outlets of every two neighboring long chambers are located in opposite ends. Then the whole drying processes are automatically performed, including conveying, squeezing, mixing and stirring material and dried quickly and in a well-balanced dried condition.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
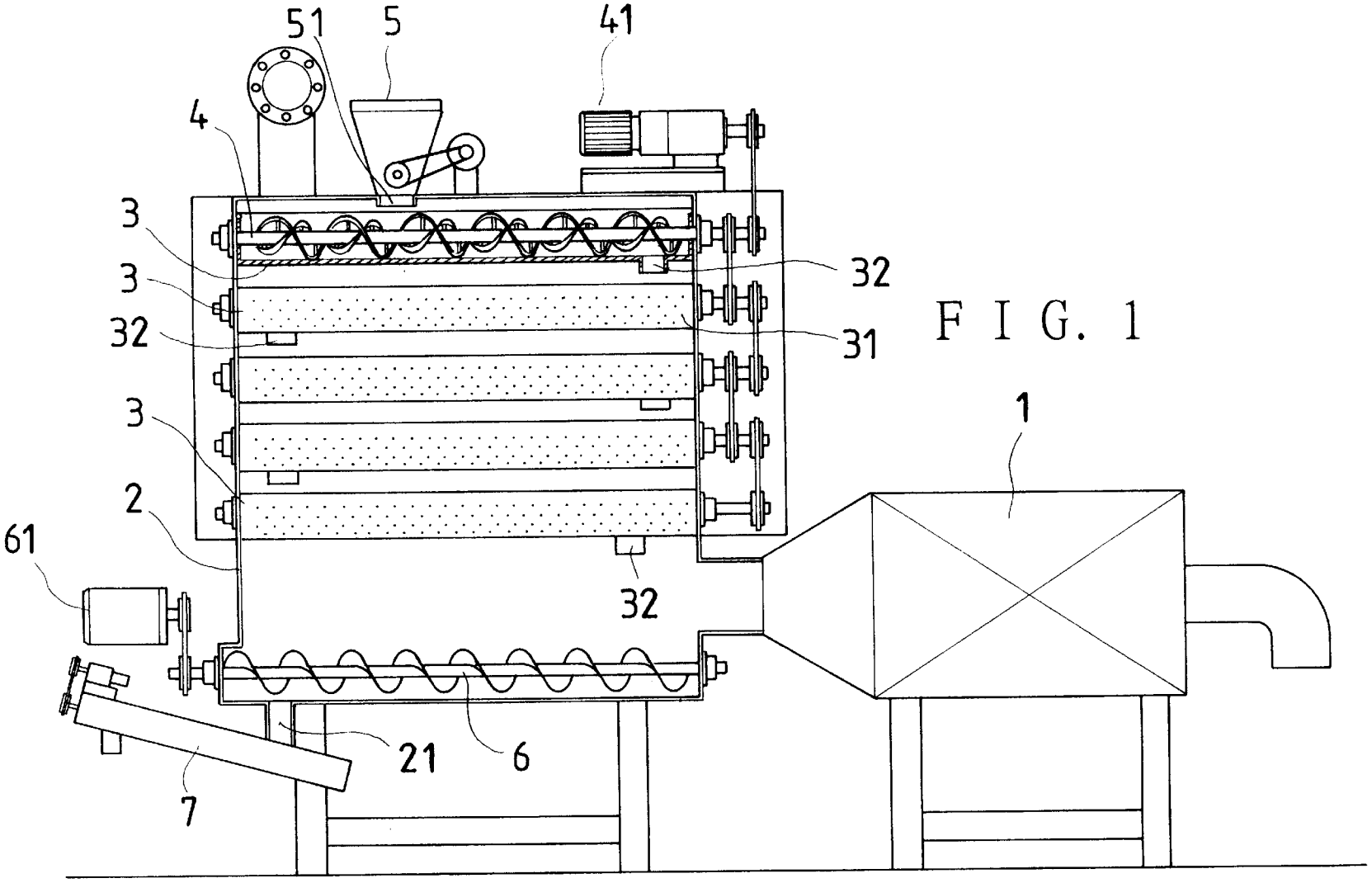
FIG. 1 is a cross-sectional view of a drying machine of the present invention.
Figure 2:
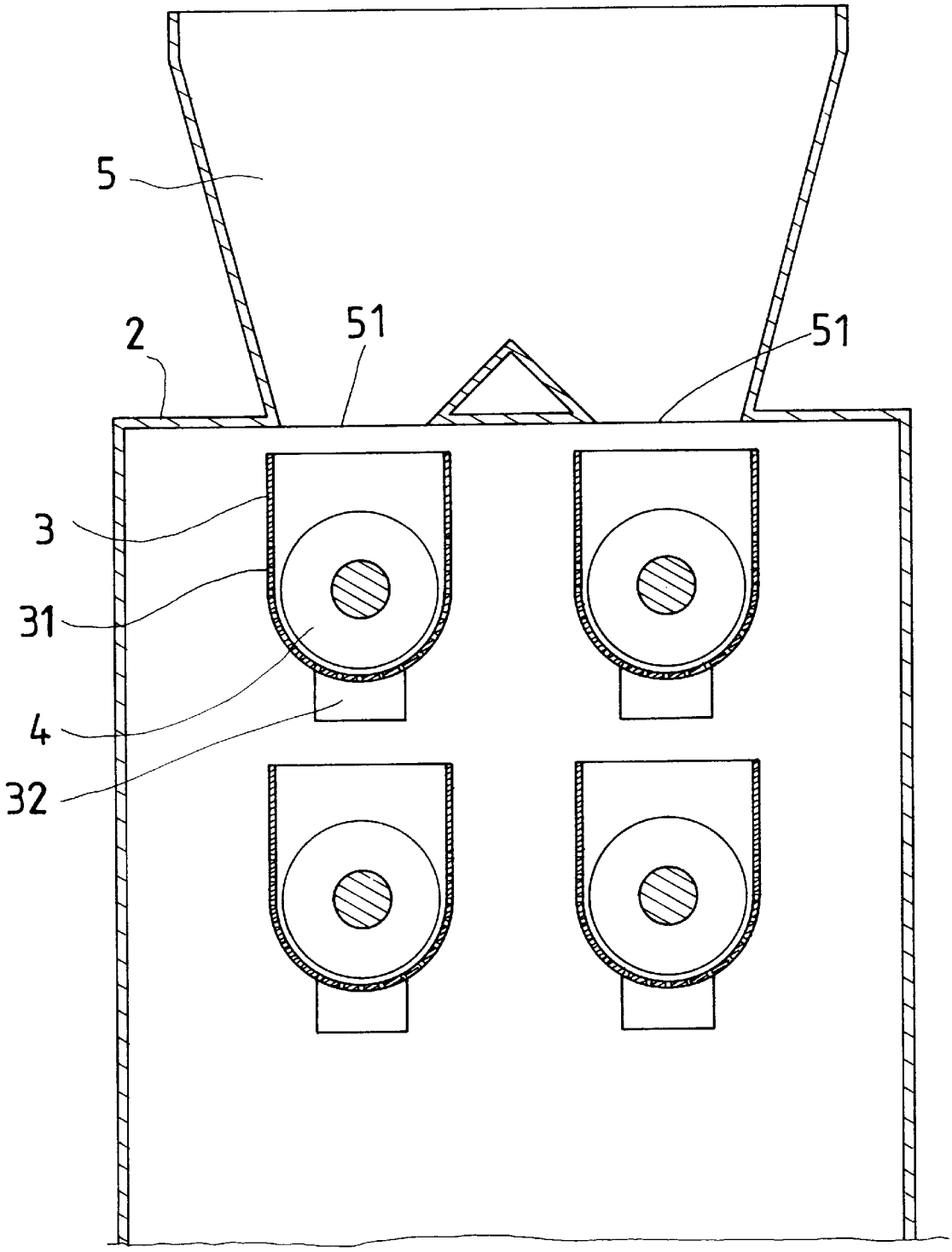
FIG. 2 is a magnified side cross-sectional view of a funnel, long chambers and a screw conveyor of the present invention.
Figure 3:
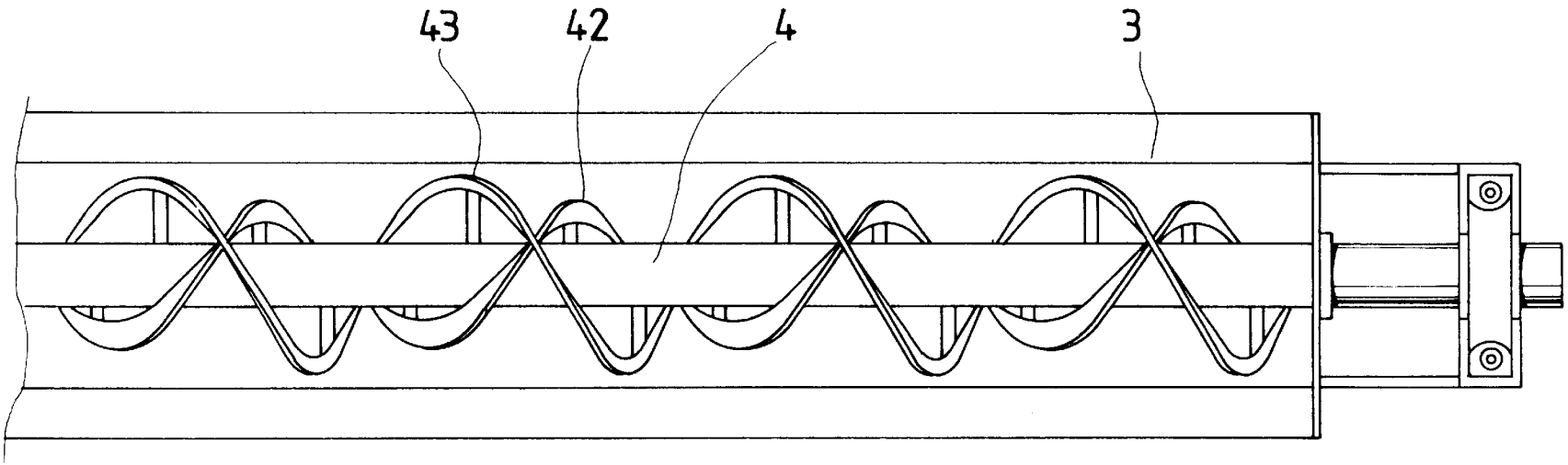
FIG. 3 is a side view of the screw conveyor of the present invention.
Figure 4:
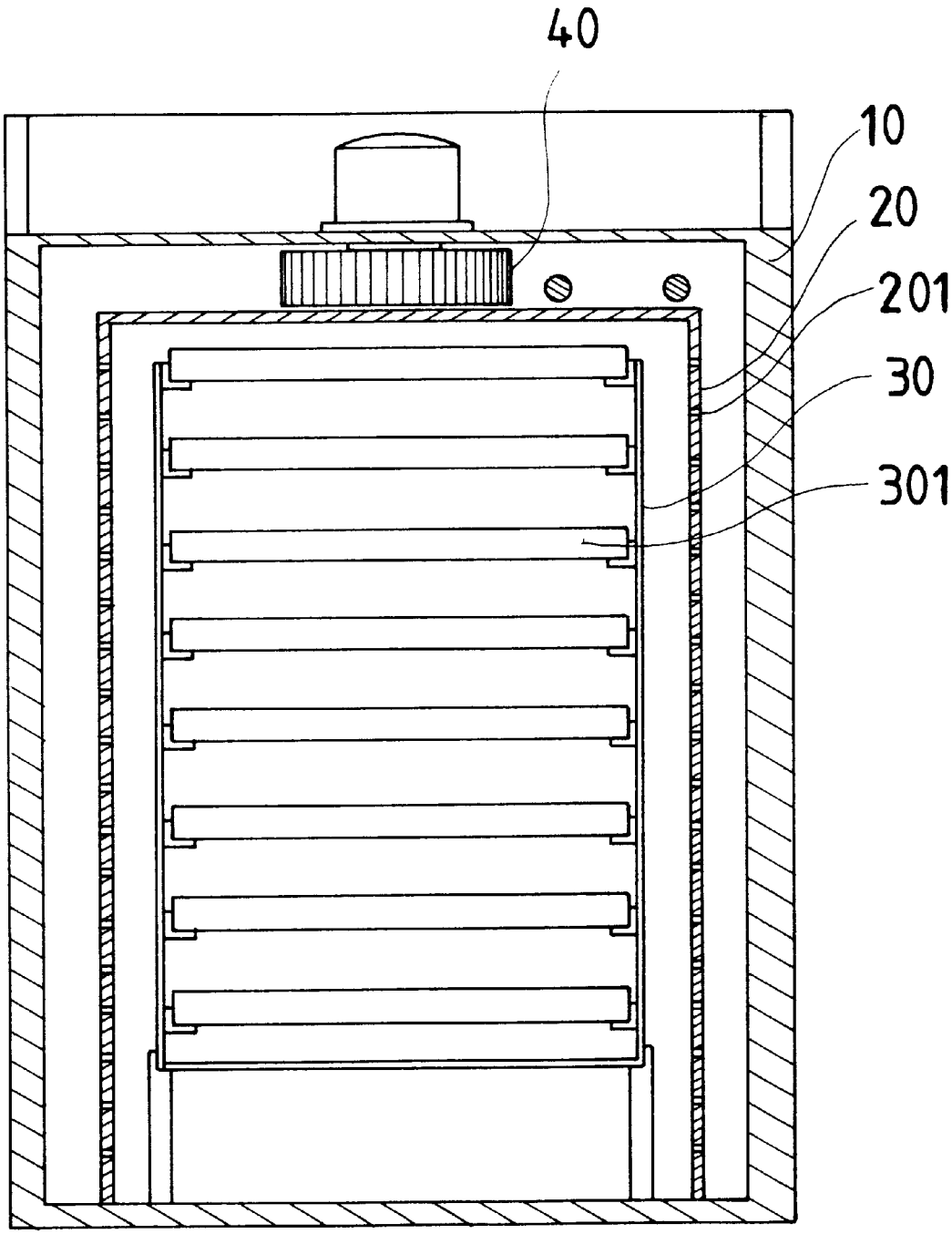
FIG. 4 (PRIOR ART)
FIG. 4 is a cross-sectional view of a first conventional drying machine.
Figure 5:
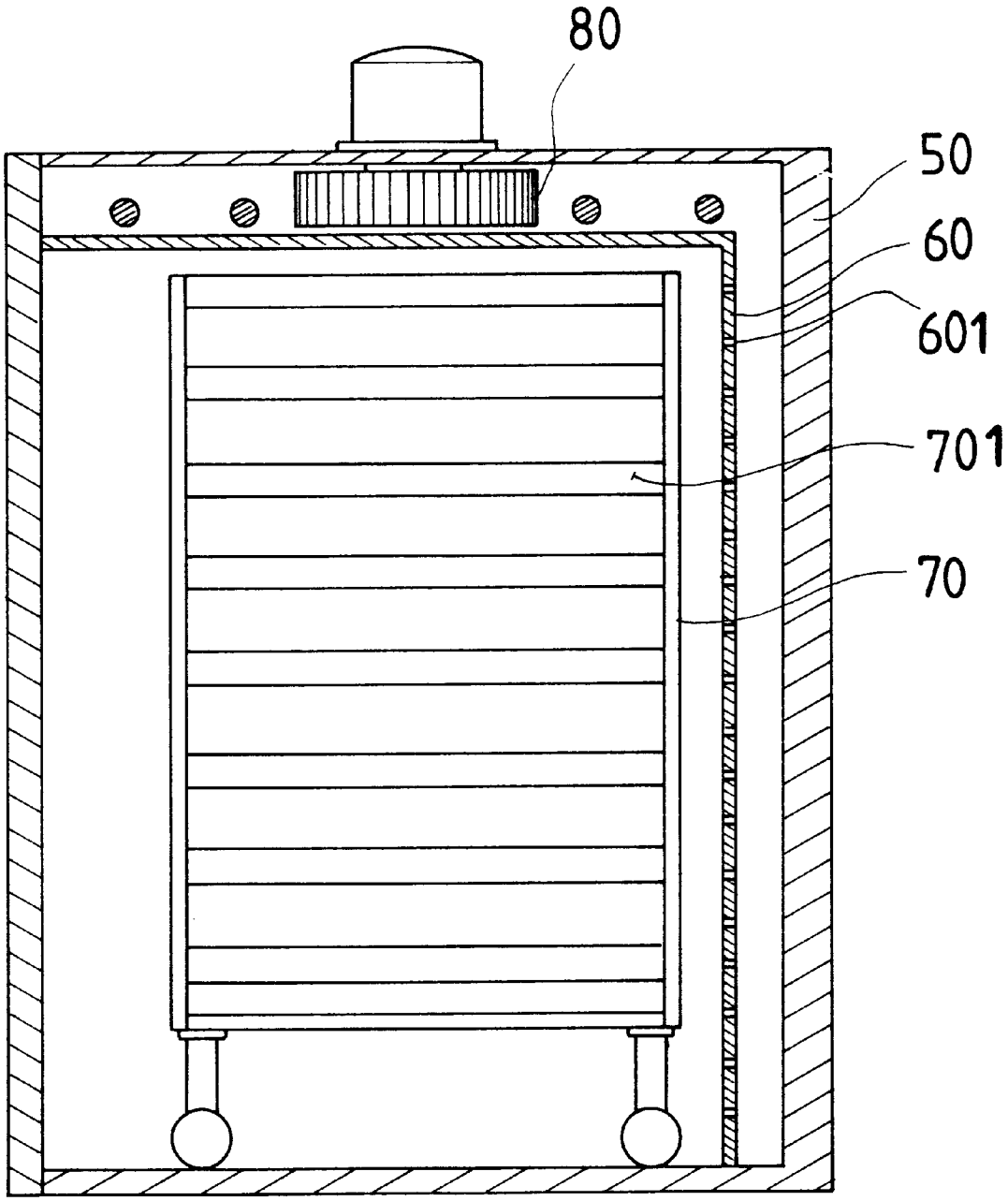
F I G. 5 (PRIOR ART)
FIG. 5 is a cross-sectional view of a second conventional drying machine.

A preferred embodiment of a drying machine of the present invention, as shown in FIGS. 1 and 2, includes a hot air blower 1, a housing 2 having its interior divided into a plurality of long chambers 3, a screw conveyor 4 respectively positioned in each long chamber 3, and a motor 41 to rotate all the screw conveyors 4 at the same time, a funnel 5, and a sending-out screw conveyor 6 as main components.

Each screw conveyor 4 has an inner screw 42 and an outer screw 43 twisting in opposite direction, and further, the outer screws 43 of the screw conveyors 3 of every two neighboring long chambers 3 twist in opposite direction.

Each long chamber 3 has its upper side completely open, thus shaping U, and many through holes 31 in two longitudinal sides and the bottom side, and an outlet 32 bored in an end of the bottom. And the outlets 32 in every two neighboring long chambers 3 are positioned in the opposite ends.

The funnel 5 is provided on an upper side of the housing 2, having a bottom mouth 51 facing down to the upper side of the highest long chamber 3.

The sending-out screw conveyor 6 is located on the bottom of the housing 2, and exit mouth 21 is provided in the bottom of the housing 2. Then a motor 61, conveying dried material falling down from the lowest long chamber 3 to the exit 21 rotates the sending-out screw conveyor 6.

In using, the hot air blower 1 started to produce and send hot air into the housing 2, and the motors 41, 61 are also started to rotate all the screw conveyors 4 and 6. Then material to be dried is fed into the funnel 5, falling down through the bottom mouth 51 into the highest long chamber 3, wherein material may be squeezed, mixed, stirred and moved by the rotating inner and outer screws 42 and 43 of the screw conveyor 4. Then material is gradually moved to and fall through the through holes 31 down to the second highest long chamber 3, being dried at the same time by hot air coming from the hot air blower 1. In addition, the outer screw 43 moves material not falling down to the outlet and fall down through the outlet 32 to the second highest long chamber 3. Hot air coming from the hot air blower 1 flows through the open upper side and the through holes 31 in the two longitudinal sides of each long chamber 3, drying material therein. Thus, material is dried orderly from the highest long chamber 3 to the second highest one and then to the third highest and so on, finally falls down into the lowest portion of the housing 3, wherein the sending-out screw conveyor 6 is rotating to move dried material to the exit 21 which is connected to a common conveyor 7 for conveying dried material to a place to be collected.

As can be realized from the aforesaid description, the drying machine in the invention has the following advantages.

1. The whole automatic drying processes including feeding, conveying, squeezing, mixing and stirring material by means of the screw conveyors, drying by hot air coming the hot air blower, conveying and collecting dried material by a sending-out screw conveyor can save labor and time for a great extent.
2. Material can be quickly conveyed and well-balanced dried by many screw conveyors.
3. The inner and the outer screws 42 and 43 of each screw conveyor 4 can squeeze, mix and stir material in a well-balanced condition.

4. Material partly falls down through the holes 31 in the bottom of each long chamber 3 and partly fall down through the outlet 32 into the next lower long chamber 3, receiving hot air coming from the blower 1, increasing speed of drying and balanced condition.

5. Provision of the many holes 31 in the bottom and the two longitudinal sides of each long chamber 3 not only permits drying by hot air flowing therethrough but increase effect of drying speed and dried condition of material.

What is claimed is:

1. A drying machine comprising a hot air blower, a housing divided horizontally into a plurality of long chambers, each said chamber having an open upper side and a closed bottom and two closed longitudinal sides, a screw conveyor positioned in each said long chamber, each said screw conveyor having an inner screw and an outer screw twisting in opposite direction, said outer screws of two said screw conveyors in every two neighboring screw conveyors twisting in opposite direction, a funnel provided on an upper side of said housing having a bottom mouth facing down to a highest long chamber, said bottom of each said long chamber having an outlet in an end, said outlets of every two said long chambers positioned in opposite of every two said long chambers positioned in opposite side ends, material to be dried fed into said funnel and falling down in the highest long chamber and automatically conveyed, squeezed, mixed, stirred by said inner and outer screws of said screw conveyors in said long chambers, permitting material dried quickly and in a well-balanced dried condition.

2. The drying machine as claimed in claim 1, wherein said long chamber is shaped as U.

3. The drying machine as claimed in claim 1, wherein each said long chamber has many through holes bored in two longitudinal sides and a bottom side for hot air coming from said hot air blower to flow therethrough.

4. The drying machine as claimed in claim 1, wherein a material sending-out screw conveyor is provided in a lower end portion of said housing, rotated by a motor, and an exit is provided in the bottom of said housing for dried material falling down from the lowest long chamber to be conveyed by said material sending-out screw conveyor to said exit.

* * * * *